US010734769B2

(12) United States Patent
Kralik et al.

(10) Patent No.: US 10,734,769 B2
(45) Date of Patent: Aug. 4, 2020

(54) SAFETY ELECTRICAL POWER CONNECTOR

(71) Applicant: Western Technology, Inc., Bremerton, WA (US)

(72) Inventors: Michael Kralik, Bremerton, WA (US); Lyal Christensen, Bremerton, WA (US)

(73) Assignee: Western Technology, Inc., Bremerton, WA (US)

( * ) Notice: Subject to any disclaimer, the term of this patent is extended or adjusted under 35 U.S.C. 154(b) by 9 days.

(21) Appl. No.: 16/040,480

(22) Filed: Jul. 19, 2018

(65) Prior Publication Data

US 2019/0140405 A1 May 9, 2019

Related U.S. Application Data

(60) Provisional application No. 62/534,517, filed on Jul. 19, 2017.

(51) Int. Cl.
*H01R 13/53* (2006.01)
*H01R 13/71* (2006.01)
(Continued)

(52) U.S. Cl.
CPC ..... *H01R 13/71* (2013.01); *H01R 13/631* (2013.01); *H01R 13/7036* (2013.01);
(Continued)

(58) Field of Classification Search
CPC .... H01R 13/71; H01R 13/631; H01R 13/036; H01R 13/53; H01R 39/46
(Continued)

(56) References Cited

U.S. PATENT DOCUMENTS 3,390,369 A 6/1968 Zavertnik et al.
3,491,326 A 1/1970 Pfister et al.
(Continued)

FOREIGN PATENT DOCUMENTS

CN 201187753 Y 1/2009
CN 204809563 U 11/2015
EP 2541689 A1 1/2013

OTHER PUBLICATIONS

Amphenol Corporation; "97 Series—Amphenol®"; (May 30, 2012); 22 pages; Standard Cylindrical Connector 12-022-16; Amphenol Industrial Operations.

(Continued)

*Primary Examiner* — Edwin A. Leon
*Assistant Examiner* — Milagros Jeancharles
(74) *Attorney, Agent, or Firm* — Thorpe North & Western, LLP

(57) ABSTRACT

A safety electrical power connector can include a first connector body having a first electrical contact and an outer surface, and a second connector body that engages the first connector body in an axial direction. The second connector body can have a second electrical contact and an inner surface configured to slide relative to the outer surface of the first connector body in the axial direction during engagement of the first and second connector bodies. The outer surface and the inner surface can define a gap therebetween sufficient to establish an isolation enclosure that isolates a volume containing the first and second electrical contacts therein. The gap can be formed prior to electrical communication of the first and second electrical contacts thereby preventing an explosion due to arcing between the first and second electrical contacts.

24 Claims, 6 Drawing Sheets

(51) Int. Cl.

| | |
|---|---|
| ***H01R 13/631*** | (2006.01) |
| ***H01R 13/703*** | (2006.01) |
| *H01R 13/24* | (2006.01) |
| *H01R 13/622* | (2006.01) |
| *H01R 39/46* | (2006.01) |

(52) U.S. Cl.
CPC ..... *H01R 13/2421* (2013.01); *H01R 13/53* (2013.01); *H01R 13/622* (2013.01); *H01R 39/46* (2013.01)

(58) Field of Classification Search
USPC ..... 200/10, 2, 4, 5, 6
See application file for complete search history.

(56) References Cited

U.S. PATENT DOCUMENTS

| | | | | |
|---|---|---|---|---|
| 3,599,167 | A * | 8/1971 | Adrian | H01R 13/633 439/186 |
| 3,805,216 | A | 4/1974 | Gaspar et al. | |
| 4,150,866 | A | 4/1979 | Snyder, Jr. et al. | |
| 4,176,898 | A | 12/1979 | Marechal | |
| 4,540,230 | A | 9/1985 | Iversen et al. | |
| 4,628,392 | A | 12/1986 | Didier | |
| 4,825,986 | A | 5/1989 | Pepper | |
| 5,145,356 | A * | 9/1992 | Minnis | B60R 21/01 439/188 |
| 5,408,149 | A | 4/1995 | Aneha et al. | |
| 5,565,714 | A | 10/1996 | Cunningham | |
| 5,582,519 | A | 12/1996 | Buchter | |
| 5,621,256 | A | 4/1997 | Crane et al. | |
| 5,762,510 | A | 6/1998 | Taniguchi et al. | |
| 5,863,221 | A | 1/1999 | Castaldo | |
| 6,146,210 | A | 11/2000 | Cha et al. | |
| 6,162,082 | A | 12/2000 | Karsten et al. | |
| 6,372,993 | B1 | 4/2002 | Eckels et al. | |
| 6,552,888 | B2 | 4/2003 | Weinberger | |
| 6,568,948 | B2 * | 5/2003 | Matsuoka | H01R 13/4361 439/271 |
| 6,685,493 | B2 | 2/2004 | Birkenmaier et al. | |
| 6,793,510 | B2 | 9/2004 | Yamakawa et al. | |
| 6,866,529 | B2 | 3/2005 | Hobson et al. | |
| 6,902,412 | B2 | 6/2005 | Higgins | |
| 6,932,636 | B2 | 8/2005 | Abbey et al. | |
| 7,794,252 | B2 | 9/2010 | Sauer et al. | |
| 7,922,529 | B1 | 4/2011 | Meurer | |
| 8,482,885 | B2 | 7/2013 | Billingsley et al. | |
| 8,721,355 | B2 | 5/2014 | Belack | |
| 8,729,741 | B2 | 5/2014 | Lai | |
| 8,905,795 | B2 | 12/2014 | Kim et al. | |
| 9,088,094 | B2 | 7/2015 | Iyer et al. | |
| 9,379,472 | B2 * | 6/2016 | Hara | H01R 13/05 |
| 9,437,381 | B2 | 9/2016 | Hassan-Ali et al. | |
| 9,564,277 | B2 | 2/2017 | Cruz et al. | |
| 2011/0121663 | A1 | 5/2011 | Coffey et al. | |
| 2013/0093242 | A1 | 4/2013 | Mok et al. | |
| 2013/0093381 | A1 | 4/2013 | McGinley et al. | |
| 2014/0127926 | A1 * | 5/2014 | Condo | H01R 13/6456 439/345 |
| 2014/0270645 | A1 | 9/2014 | Toth | |
| 2014/0273571 | A1 * | 9/2014 | Iyer | H01R 13/53 439/183 |
| 2014/0285318 | A1 | 9/2014 | Audéon et al. | |
| 2016/0079749 | A1 | 3/2016 | Jung et al. | |
| 2016/0111870 | A1 | 4/2016 | Murano et al. | |
| 2016/0182039 | A1 | 6/2016 | Xiao et al. | |
| 2016/0370547 | A1 | 12/2016 | Logan, Jr. et al. | |
| 2017/0098908 | A1 * | 4/2017 | Juds | H01R 13/53 |

OTHER PUBLICATIONS

Ken Shirriff; "Teardown and Exploration of Apple's Magsafe Connector"; Apple; Ken Shirriff's Blog—Charger, Microprocessors, Arduino, and Whatever; (Jun. 2, 2013); 35 pages; kens@arcfn.com; [retrieved on Feb. 6, 2017]; Retrieved from <URL: http://www.righto.com/2013/06/teardown-and-exploration-of-magsafe.html >.

Meltric Corporation; "DXN Hazardous Location Rated Plugs and Receptacles—ATEX and CSA"; (Jul. 12, 2017); 2 pages; [retrieved on Oct. 18, 2018]; Retrieved from <URL:http://www.meltric.com/html/dxn-hazardous-location.html# >.

Nevon Projects; "Power Supply with Auto Switching"; Nevon; (Mar. 17, 2013); 4 pages; [retrieved on Feb. 12, 2017); Retrieved from <URL: http://nevonprojects.com/power-supply-with-auto-switching-project/ >.

* cited by examiner

SAFETY ELECTRICAL POWER CONNECTOR

RELATED APPLICATION

This application claims priority to U.S. Provisional Application No. 62/534,517, filed Jul. 19, 2017 which is incorporated herein by reference.

BACKGROUND

Industrial environments (e.g., mining, paint and coatings, oil and gas, robotic manufacturing lines, high dust industrial environments, etc.) are governed by strict safety standards, such as 29 CFR 1910 and 29 CFR 1926 (April 2017), with equipment regulated by safety standards, such as UL 1203 and UL 844, to prevent explosions due to sparks or arcing originating from electrical wires and connectors. For example, when power is left on during the uncoupling of a connector, arcing can occur between the electrical connectors as they disengage. If combustible conditions are present (e.g. dust, vapors, gases, etc), as is often the case in industrial environments, this arcing can lead to an explosion. Safety standards typically specify permissible electrical wires and connectors including materials, flame paths (e.g., spark production), conductor separation distances, maximum gap distances, etc. A variety of connectors have been designed that meet the applicable safety standards. Despite compliance with such safety standards, however, there is room for improvement in connector designs to make connectors that are robust (e.g., fool-proof), reduced risk, and user friendly.

SUMMARY

A safety electrical power connector is disclosed herein that can meet safety standards by mechanical and physical isolation of connector contacts from surrounding environment as those contacts come into close proximity. In one aspect, the safety electrical power connector can facilitate safe connect/disconnect while power is on by mechanically severing power within the connector upon disconnect and therefore no need for an operator to turn power off or de-energize the lines when connecting/disconnecting. The safety electrical power connector can include a first connector body having a first electrical contact and an outer surface, and a second connector body that engages the first connector body in an axial direction. The second connector body can have a second electrical contact and an inner surface configured to slide relative to the outer surface of the first connector body in the axial direction during engagement of the first and second connector bodies. The outer surface and the inner surface can define a gap therebetween sufficient to establish an isolation enclosure that isolates a volume containing the first and second electrical contacts therein. The gap can be formed prior to electrical communication of the first and second electrical contacts thereby preventing an explosion due to arcing between the first and second electrical contacts.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Figure 1:
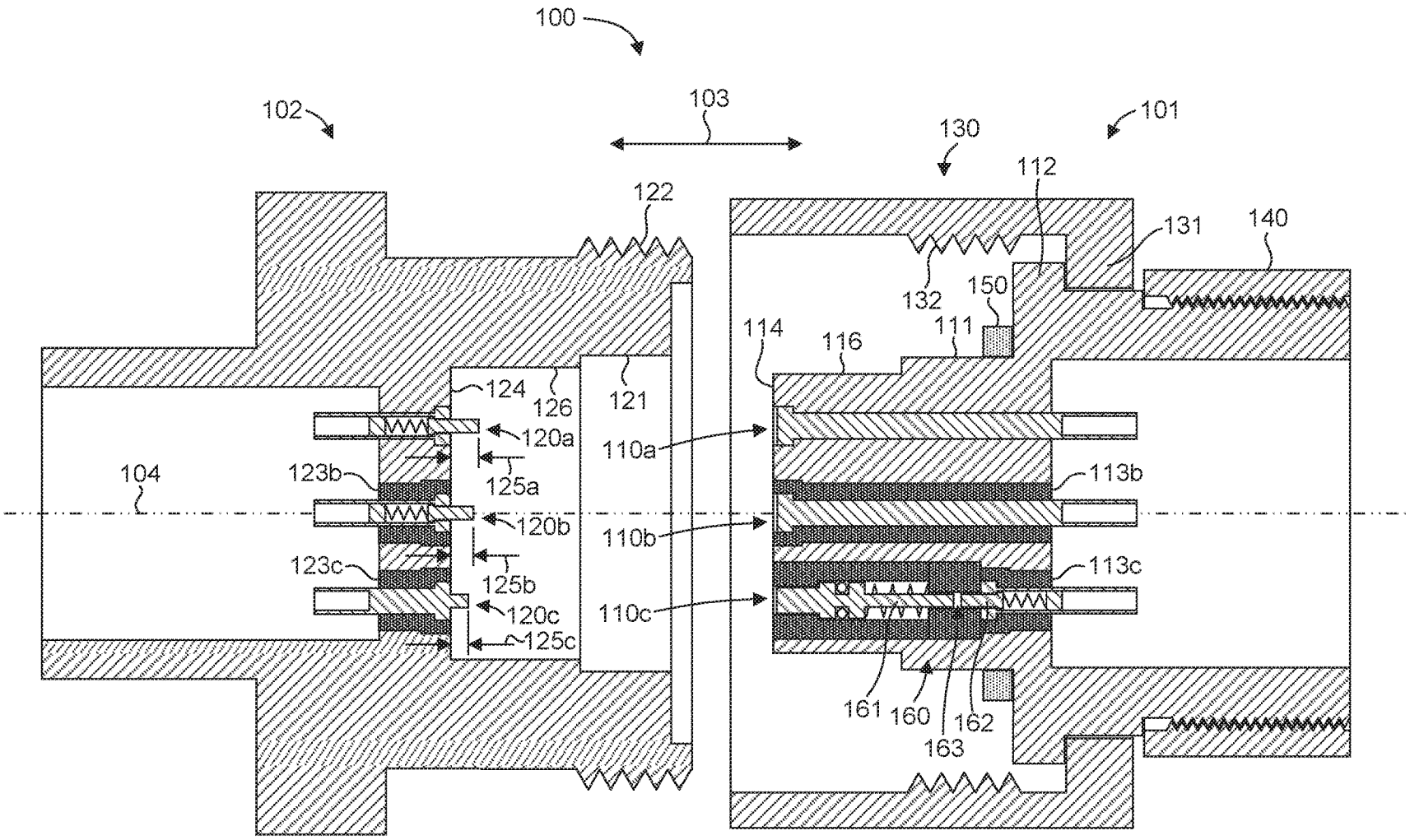
FIG. 1 is a side cross-sectional view of a safety electrical power connector in accordance with an example of the present disclosure.

These drawings are provided to illustrate various aspects of the invention and are not intended to be limiting of the scope in terms of dimensions, materials, configurations, arrangements or proportions unless otherwise limited by the claims.

DETAILED DESCRIPTION

While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

Definitions

In describing and claiming the present invention, the following terminology will be used.

The singular forms "a," "an," and "the" include plural referents unless the context clearly dictates otherwise. Thus, for example, reference to "an electrical contact" includes reference to one or more of such features and reference to "engaging" refers to one or more of such steps.

As used herein with respect to an identified property or circumstance, "substantially" refers to a degree of deviation that is sufficiently small so as to not measurably detract from the identified property or circumstance. The exact degree of deviation allowable may in some cases depend on the specific context.

As used herein, the term "about" is used to provide flexibility and imprecision associated with a given term, metric or value. The degree of flexibility for a particular variable can be readily determined by one skilled in the art. However, unless otherwise enunciated, the term "about" generally connotes flexibility of less than 2%, and most often less than 1%, and in some cases less than 0.01%.

As used herein, a plurality of items, structural elements, compositional elements, and/or materials may be presented in a common list for convenience. However, these lists should be construed as though each member of the list is individually identified as a separate and unique member.

Thus, no individual member of such list should be construed as a de facto equivalent of any other member of the same list solely based on their presentation in a common group without indications to the contrary.

As used herein, the term "at least one of" is intended to be synonymous with "one or more of" For example, "at least one of A, B and C" explicitly includes only A, only B, only C, or combinations of each.

Numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of about 1 to about 4.5 should be interpreted to include not only the explicitly recited limits of 1 to about 4.5, but also to include individual numerals such as 2, 3, 4, and sub-ranges such as 1 to 3, 2 to 4, etc. The same principle applies to ranges reciting only one numerical value, such as "less than about 4.5," which should be interpreted to include all of the above-recited values and ranges. Further, such an interpretation should apply regardless of the breadth of the range or the characteristic being described.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Safety Electrical Power Connector

With reference to FIG. 1, a safety electrical power connector 100 is illustrated in accordance with an example of the present disclosure. The connector 100 can include connector bodies 101, 102. The connector body 101 can include electrical contacts 110*a-c*, while connector body 102 can include electrical contacts 120*a-c*. FIG. 1 shows the connector bodies 101, 102 in a disconnected or uncoupled state where the connector bodies and corresponding electrical contacts are remote and spaced from one another. The connector bodies 101, 102 can engage one another in an axial direction 103 (i.e., parallel to a central axis 104 of the connector 100) to form an electrical connection or coupling of the respective electrical contacts 110*a-c*, 120*a-c* as shown in FIGS. 3A-3G and discussed in more detail below.

In one aspect, the connector body 101 can be configured as a plug and the connector body 102 can be configured as a socket that receives the plug. For example, the connector body 101 can have an outer surface 111, and the connector body 102 can have a complimentary inner surface 121 configured to slide relative to the outer surface 111 of the connector body 101 in the axial direction 103 during engagement of the connector bodies 101, 102. In one embodiment, the outer and complimentary inner surfaces 111, 121 can be cylindrical, although it should be recognized that these surfaces can have any suitable shape or configuration. Generally the outer an inner complimentary surfaces can have a constant complimentary cross-section over the engagement portion. Non-limiting examples of suitable surface shapes can include cylindrical, square, rectangular, elliptical, triangular, hexagonal, pentagonal, and the like, including such shapes having rounded vertices or corners.

The connector 100 can also include a securing member 130 associated with the connector body 101 or the connector body 102 to secure the connector bodies 101, 102 to one another. In some embodiments, the securing member 130 can comprise a threaded sleeve configured to threadingly engage a threaded surface of the connector body 101 or the connector body 102. In the illustrated embodiment, the securing member 130 is associated with the connector body 101. The securing member 130 can have an inwardly oriented flange 131 configured to bear against an outwardly oriented flange 112 of the connector body 101. A capture member 140 can be coupled to the connector body 101 (e.g., via a threaded interface) to capture the securing member 130 such that the securing member 130 is maintained about the connector body 101, such as when disconnected from the connector body 102. In addition, the securing member 130 can comprise a threaded sleeve having a threaded surface 132 configured to threadingly engage a threaded surface 122 of the connector body 102. As described in more detail below, the threaded surfaces 122, 132 can facilitate coupling and uncoupling of the connector bodies 101, 102 in addition to securing the connector bodies once coupled to one another. During disconnect the securing member 130 can bear against the capture member 140 while unthreading from the connector 102 to facilitate movement of the connector bodies 101, 102 away from one another. The securing member 130 and the capture member 140 can be constructed of any suitable material, such as a metal material (e.g., aluminum, copper, iron, etc. alone or in any combination).

The connector 100 can include a seal 150 configured to interface with the connector bodies 101, 102 to form a seal between the connector bodies 101, 102 when coupled or connected to one another. The seal 150 can form a barrier protecting the electrical connections from environmental conditions. When sealed, the connector 100 can be resistant to water and/or debris. In the illustrated embodiment, the seal 150 is disposed about the connector body 101 proximate the outer surface 111. The seal 150 can be constructed of any suitable material, such as a polymeric material. In some cases, the seal 150 can be a gasket or other continuous ring or loop structures.

The electrical contacts 110*a-c*, 120*a-c* can be associated with or coupled to any suitable conductor of an electrical power line (not shown). For example, the corresponding electrical contacts 110*b*, 120*b* and the corresponding electrical contacts 110*c*, 120*c* can be associated with supply, common, and/or neutral conductors of electrical power lines and can therefore be referred to as supply, common, and/or neutral contacts, as applicable (including variations in loading, signal, etc). In addition, the corresponding electrical contacts can be associated with ground conductors of electrical power lines and can therefore be referred to as ground contacts. In general, the electrical contacts 110*a-c*, 120*a-c* can be designed for bulk power coupling. As a general guideline, bulk power couplings can include high capacity couplings to building main power lines, high capacity modular generators used to power work environments with demanding loads, electrical systems with multiple drop points of power hook-up, and the like. Further, high power lines may utilize single contact coupling connectors; although, the system as a whole, would not be energized until proper contacts are confirmed, and the feedback sensor loop is properly established.

Regardless, the contact materials, e.g. copper, aluminum, brass, and diameters should meet minimum NEC wire diameter based upon current flow through the powered system. For example, a 30 A capacity system, requires 10 AWG copper wire, which measures 0.5261 $mm^2$, with a diameter of 2.588 mm. Thus, the contact for best performance, would meet these same dimensional criteria. Although three corresponding electrical contacts (i.e., pairs) are shown in the illustrated embodiment, it should be recognized that a safety electrical power connector in accordance with the present disclosure can include any suitable number of electrical contacts as desired to adequately couple the number and type of conductors in a given electrical power line.

The connector bodies 101, 102 can be constructed of any suitable material. In some embodiments, one or both of the connector bodies 101, 102 can be constructed of a metal material (e.g., aluminum, copper, iron, nickel, etc. alone or in any combination). In such cases, the electrical contacts 110*a-c*, 120*a-c* can be separated from the metal material by electrically insulative liners or sleeves. In one embodiment, the electrical contacts 110*b*, 110*c*, 120*b*, 120*c* can be supply, common, and/or neutral contacts and can therefore be separated from metal material of the connector bodies 101, 102 by electrically insulative liners 113*b*, 113*c*, 123*b*, 123*c* disposed about the respective electrical contacts. The electrical contacts 110*a*, 120*a* can be ground contacts and can therefore be in contact with the metal material of the connector bodies 101, 102. The electrically insulative liners 113*b*, 113*c*, 123*b*, 123*c* can be constructed of any suitable material, such as a dielectric material (e.g., a suitable polymer). The electrical contacts and the electrically insulative liners can be coupled to one another and to the connector bodies 101, 102 in any suitable manner, such as threadedly coupled, adhesively coupled, and/or configured to have an interference fit.

The electrical contacts 110*a-c*, 120*a-c* can have any suitable configuration. For example, the 110*a-c*, 120*a-c* can include a pin, a pogo pin, a receptacle, a landing, a pad, etc. alone or in any combination. In the illustrated embodiment, the electrical contacts 110*a*, 110*b*, 120*c* can comprise fixed pins and the electrical contacts 110*c*, 120*a*, 120*b* can comprise pogo pins (i.e., spring-loaded pins). The pogo pins can move in the direction 103 parallel to the axis 104 of the connector 100. The pin heads or contact surfaces can have any suitable shape or configuration, such as rounded (e.g., semi-spherical), flat, pointed, etc. In one aspect, fixed or pogo pins can be flush or recessed with respect to facing surfaces 114, 124 of the respective connector bodies 101, 102. For example, the fixed pins 110*a*, 110*b* can have flat contact surfaces flush or (slightly) recessed with respect to the facing surface 114. The pogo pin 110*c* can have a flat contact surface flush or (slightly) recessed with respect to the facing surface 114. In another aspect, fixed or pogo pins can protrude with respect to the facing surfaces 114, 124. For example, the pogo pins 120*a*, 120*b* can have contact surfaces that protrude with respect to the facing surface 124. In addition, the fixed pin 120*c* can have a contact surface that protrudes with respect to the facing surface 124. Protruding pins can have any suitable protrusion length from the facing surfaces 114, 124. For example, the protruding pins 120*a-c* can protrude from the facing surface 124 by protrusion lengths 125*a-c*, respectively.

In one aspect, fixed and pogo pins can be configured to facilitate ease of cleaning and avoidance of debris build-up. For example, the flush or recessed pins 110*a-c* and the facing surface 114 can provide a substantially flat surface that is easily cleaned and does not promote accumulation of debris. In addition, the use of spring-loaded contacts can enable the protruding pins 120*a-c* to have protrusion lengths 125*a-c* configured to allow the pins 120*a-c* to be readily cleaned and avoid trapping or capturing debris. In one embodiment, the protruding pins 120*a-c* can be configured as stubs with minimal protrusion lengths 125*a-c*. As a general guideline, protrusion lengths can vary from about 0.5 mm to 5 mm, and most often from 2 mm to 4 mm. The pogo pins 110*c*, 120*a*, 120*b* can provide any suitable range of motion or travel to accommodate a given distance between the facing surfaces 114, 124 and the protrusion lengths 125*a-c*. The pogo pins 110*c*, 120*a*, 120*b* can therefore provide a reliable electrical contact with the corresponding fixed pins 120*c*, 110*a*, 110*b* when the connector bodies 101, 102 are coupled with one another.

In one aspect, the ground contacts 110*a*, 120*a* can be configured to contact one another prior to the other contacts 110*b*, 120*b* and 110*c*, 120*c* (e.g., supply, common, and/or neutral contacts) contacting one another when the connector bodies 101, 102 are engaged with one another. In addition, the ground contacts 110*a*, 120*a* can disconnect from one another after the other contacts 110*b*, 120*b* and 110*c*, 120*c* disconnect from one another when the connector bodies 101, 102 are disengaged from one another to prevent sparking. For example, the protrusion length 125*a* of the ground contact 120*a* can be greater than the protrusion lengths 125*b*, 125*c* of the other contacts (e.g. supply, common, and/or neutral contacts), which can enable prior contact and earlier separation of the ground contacts 110*a*, 120*a* relative to the other contacts 110*b*, 120*b*, and 110*c*, 120*c*. Other protrusion lengths can be configured to establish an order of contact and separation of the various contacts. For example, the protrusion length 125*b* can be greater than the protrusion length 125*c* such that the contacts 110*b*, 120*b* contact one another prior to the contacts 110*c*, 120*c* contacting one another, and separate after the contacts 110*c*, 120*c* separate from one another.

In some embodiments, the connector 100 can be configured to mechanically sever power when the connector bodies 101, 102 begin to be separated from one another. For example, the contact 110*c* can be associated with or configured as an interlock mechanism 160 that provides electrical continuity when the connector bodies 101, 102 are fully engaged and severs electrical continuity when the connector bodies 101, 102 become disengaged or begin to be separated from one another. In most cases, the interlock mechanism 160 can sever power with contact 110*c* until the connector bodies 101, 102 are sufficiently engaged to isolate the contacts as described in more detail herein. In one aspect, the connector body 101 can supply power to the connector body 102 (e.g., the connector body 101 can be coupled to a power source for delivery to a power consuming device coupled to the connector body 102). Thus, severing power in the connector body 101 can sever power in both the connector bodies 101, 102. The interlock mechanism 160 can include interlock contact pins 161, 162 that contact one another when the connector bodies 101, 102 are fully engaged, and separate from one another to sever electrical continuity when the connector bodies 101, 102 become disengaged or begin to be separated from one another. In other words, the interlock contact pins 161, 162 can be normally open or electrically disconnected from one another by a gap 163, thus severing power in the connector body 101 to provide safe handling of the connector bodies 101, 102 when disconnected. The interlock contact 161 can be spring-loaded and biased away from the interlock contact 162. In addition, the interlock contact 162 can be spring-loaded and biased toward the interlock contact 161. Upon contact with the fixed protruding pin 120*c* due to movement of the connector bodies 101, 102 toward one another, the interlock contact 161 begins to move toward the interlock contact 162. Once contact is made between the interlock contacts 161, 162, there is electrical continuity through the contact 110*c*. The spring-loaded interlock contact 162 can accommodate additional movement of the interlock contact 161 against the interlock contact 162, such as due to additional movement of the connector bodies 101, 102 toward one another. When the connector bodies 101, 102 move away from one another, movement of the fixed protruding pin 120*c* away from the connector body 101 allows the biased interlock contact 161 to move away from the interlock contact 162 once the interlock contact 162 has biased against its travel stop. When the interlock contacts 161, 162 separate from one another there is electrical discontinuity in the contact 110*c*, thus severing power in the connector body 101. Because the connector body 102 is not coupled to a power source and power is severed within the connector body 101, the connector bodies 101, 102 are safe and unable to generate sparks or arcing when disconnected. Thus, the connector 100 can facilitate safe connect/disconnect of the connector bodies 101, 102 while power is "hot" with no need to manually turn power off or de-energize the lines.

In one aspect, the interlock mechanism 160 can be connected to a load control apparatus having an interlock circuit that electrically uncouples an input load terminal to prevent power from reaching an output load terminal, such as the electrical contact 110*c* via the interlock mechanism 160. As mentioned above, the electrical contacts 110*c*, 120*c* can be configured to contact one another after the other contacts have contacted one another and to separate from one another prior to separation of the other contacts. This can ensure that there is never a generated spark at the electrical contacts. In one specific example, the contacts can contact one another upon assembly in the following order: ground, common, other conductors (interlocked or not), positive (with an interlock), and sensor (a low-voltage line connected to an interlock circuit which can optionally include an interlock mechanism). The interlock mechanism 160 can therefore serve as a sensor triggering an auto-relay system (e.g., the interlock circuit) to provide additional safety as well as increase the life of the electrical contacts due to reducing or eliminating surface damage resulting from arcing between the contacts. Alternatively, the sensor line can be an optically conductive path (e.g. non-electrical path) such as an optically conductive pin associated with an optical cable. The interlock mechanism 160 can generally be oriented on the positive conductor. Additional description of a corresponding interlock circuit can be found in U.S. Provisional Patent Application No. 62/537,787, filed July 27, which is incorporated herein by reference.

Figure 2A:
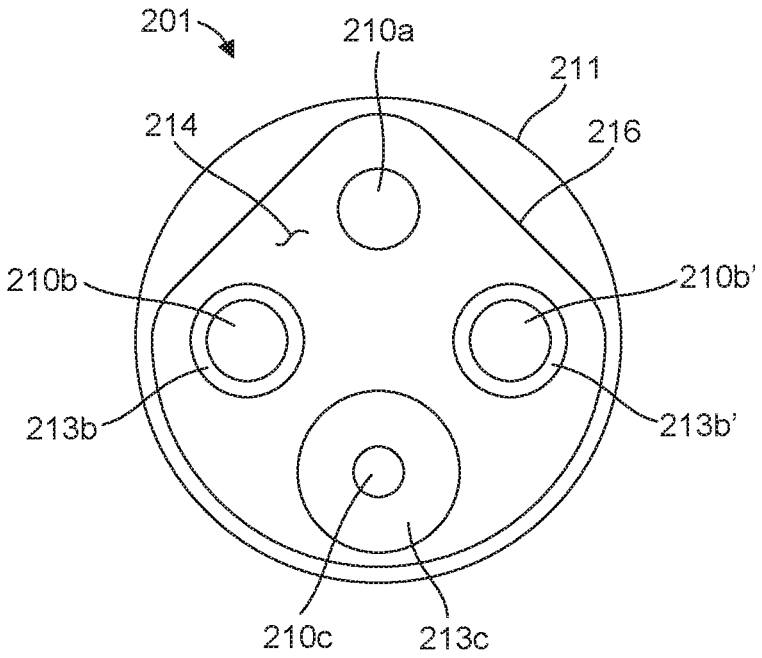
FIGS. 2A and 2B are end views of connector bodies of a safety electrical power connector in accordance with another example of the present disclosure.
Figure 2B:
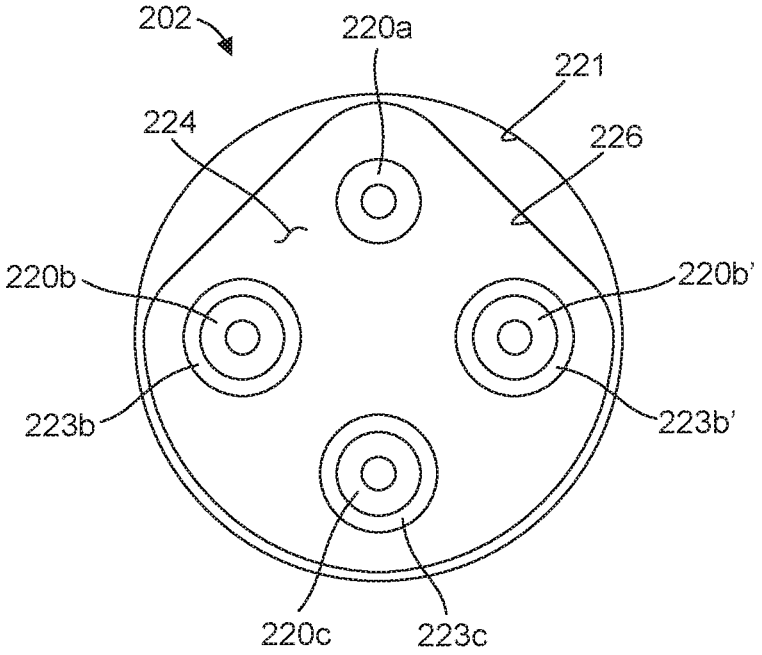

The connector bodies 101, 102 can include alignment surfaces 116, 126, respectively, that engage and mate with one another to facilitate alignment of the corresponding electrical contacts. The alignment surfaces 116, 126 can have any suitable shape or configuration. One example is shown in FIGS. 2A and 2B, which illustrate end views of connector bodies 201, 202 that include respective alignment surfaces 216, 226. The connector body 201 includes electrical contacts 210*a*, 210*b*, 210*b*', 210*c*, and the connector body 202 includes corresponding electrical contacts 220*a*, 220*b*, 220*b*', 220*c*. The electrical contacts 210*a*, 210*b*, 210*b*', 210*c* can be flush or (slightly) recessed with respect to facing surface 214. The electrical contacts 220*a*, 220*b*, 220*b*', 220*c* can protrude from facing surface 224. The electrical contacts 210*b*, 210*b*', 210*c*, 220*b*, 220*b*', 220*c* can be supply and/or neutral contacts and can therefore be separated from metal material of the connector bodies 201, 202 by electrically insulative liners 213*b*, 213*b*', 213*c*, 223*b*, 223*b*', 223*c* disposed about the respective electrical contacts. The electrical contacts 210*a*, 220*a* can be ground contacts and can therefore be in contact with metal material of the connector bodies 201, 202.

The alignment surface 216, an outer surface 211, and the facing surface 214 can form part of a plug or protruding configuration. The alignment surface 226, an inner surface 221, and the facing surface 224 can form part of a receptacle or socket configuration. Thus, electrical contacts 210*a*, 210*b*, 210*b*', 210*c* can be exposed at an end of the plug connector body 201, and electrical contacts 220*a*, 220*b*, 220*b*', 220*c* can be exposed within the socket connector body 202. In this example, the alignment surfaces 216, 226 each include a semicircular portion and two flat portions. The flat portions establish and maintain a given relationship between the alignment surfaces 216, 226 to properly align the corresponding electrical contacts of the connector bodies 201, 202. Thus, generally the alignment surfaces can have a keyed relationship such that only a single orientation is allowed when the socket connector and plug connector body are engaged. Other keyed shapes can also be used such as, but not limited to, asymmetric shapes, kidney shapes, multiple lobe shapes, regular shapes (e.g. circular, square, rectangular, triangular, hexagonal, etc) having complimentary key notches, and the like. These shapes are based upon a two-dimensional x-y cross-section. However, the alignment surfaces can occur in a z-direction. For example, varying contact heights can facilitate the complimentary keyed relationship for alignment. In another example, a circular design as the primary mating faces can have secondary contacts of varying height to ensure a keyed interface.

In yet another alternative, the keyed interface can be external to the contacts and designed into the outer housing of the connector. In one example, the outer housing could be trapezoidal in shape with clips to retain the coupling once made, e.g. a larger version of panel mount multi-pin D Sub connectors for computers.

Corresponding electrical contacts can be disposed or arranged in any suitable configuration (e.g., pattern) and the alignment surfaces 216, 226 can be configured to align the corresponding electrical contacts with one another. In some embodiments, the outer and inner surfaces 211, 221 can also be configured as alignment surfaces to provide the alignment functions described herein.

Figure 3A:
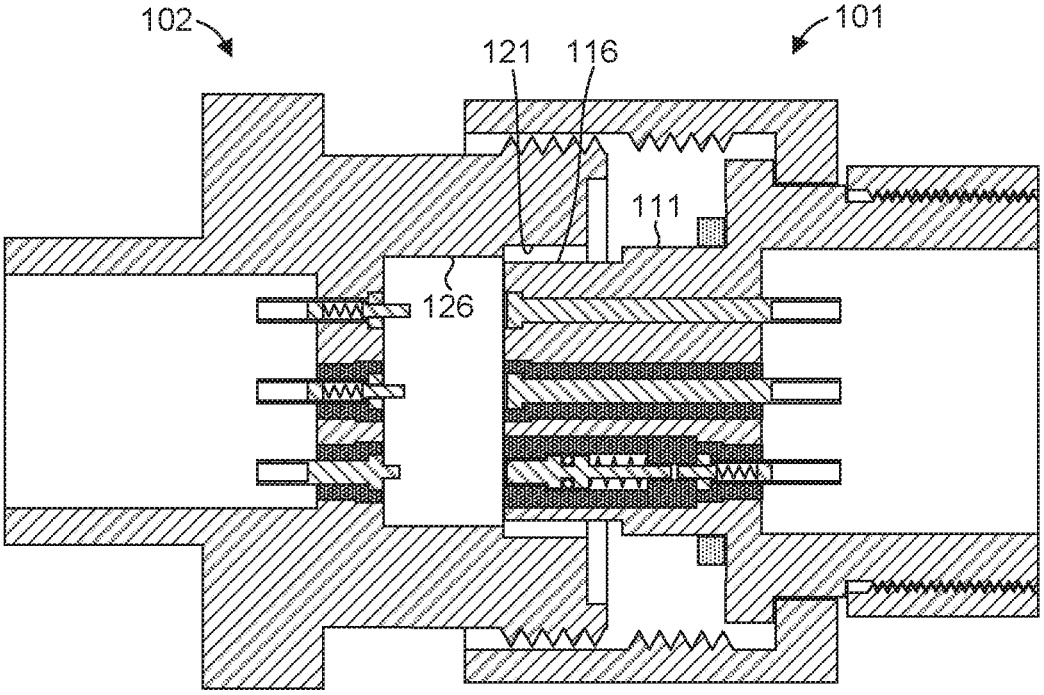
FIGS. 3A-3G illustrate connection of connector bodies of the safety electrical power connector of FIG. 1.

With further reference to FIG. 1, FIGS. 3A-3G illustrate connecting or coupling the connector bodies 101, 102 of the connector 100. As shown in FIG. 3A, the connector bodies 101, 102 can be moved toward one another with the alignment surfaces 116, 126 properly oriented to mate with one another and ensure correct alignment of the electrical contacts. The alignment surfaces 116, 126 can engage prior to the outer and inner surfaces 111, 121 during engagement of the connector bodies 101, 102. This initial engagement of alignment surfaces 116 and 126 can provide a preliminary isolation. However, the alignment surfaces 116, 126 can be configured with a relatively loose fit compared to that of the outer and inner surfaces 111, 121 as the tightness of the fit between the alignment surfaces 116, 126 need only be sufficient to adequately align corresponding electrical contacts.

Figure 3B:
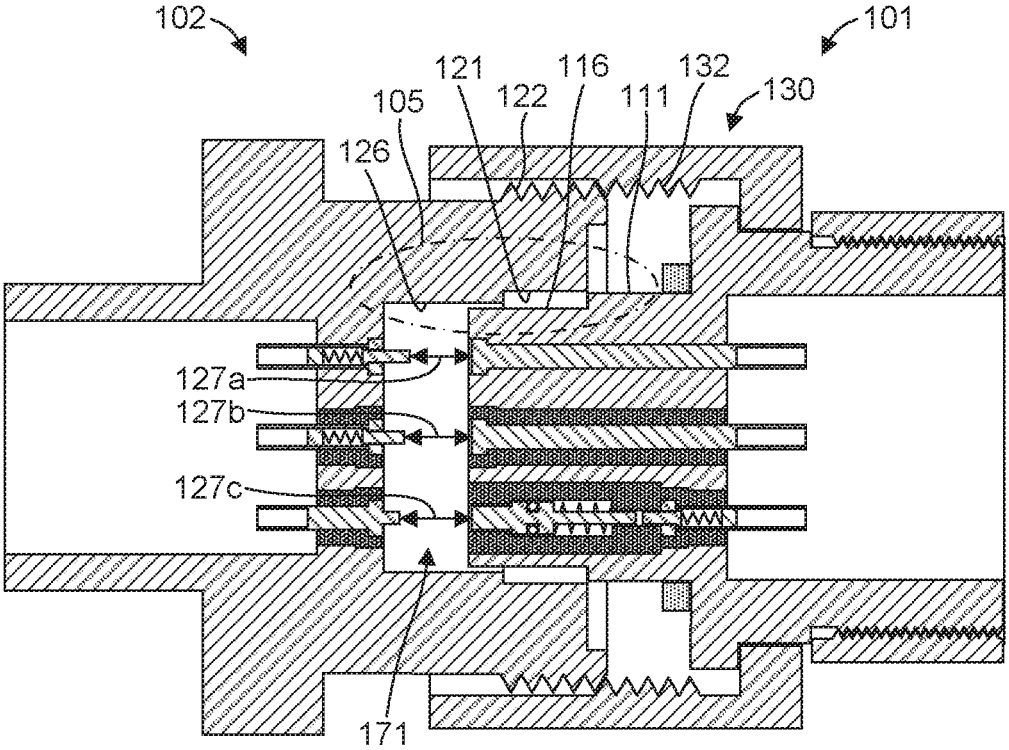
Figure 4:
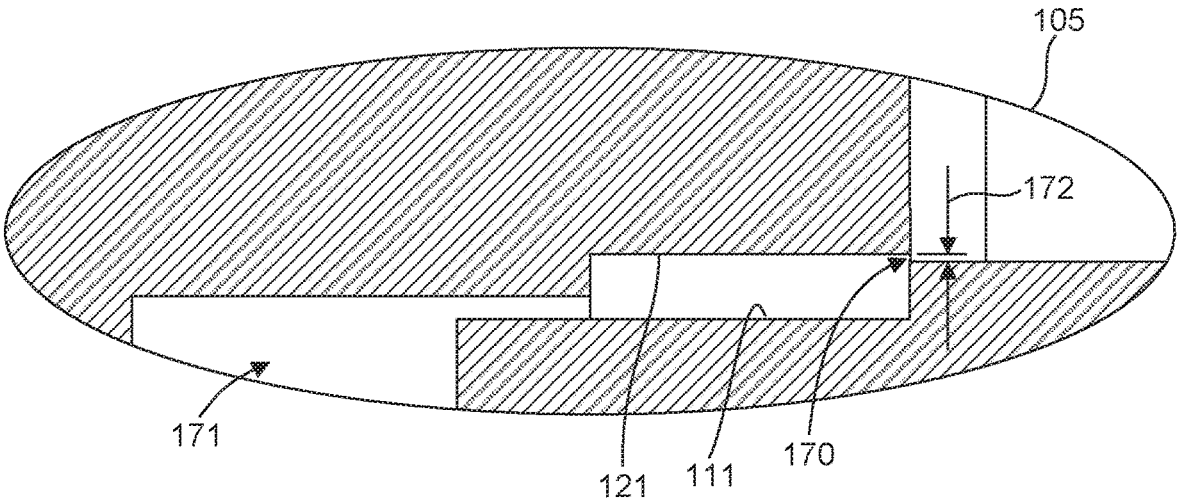
FIG. 4 is a detail view of a gap formed between connector bodies of the safety electrical power connector of FIG. 1 sufficient to establish an isolation enclosure that atmospherically isolates a volume containing electrical contacts of the connector.

With the alignment surfaces 116, 126 properly oriented, the connector bodies 101, 102 can be moved further toward one another. At a certain point, as shown in FIG. 3B, the outer and inner surfaces 111, 121 will also engage one another. A detail view of a region 105 is illustrated in FIG. 4 that shows the initial engagement between the outer and inner surfaces 111, 121. The threaded surface 132 of the securing member 130 and the threaded surface 122 of the connector body 102 may not be in threaded engagement at this point. The detail view of FIG. 4 shows that the outer and inner surfaces 111, 121 can define a gap 170 between the surfaces. The gap 170 can be sufficient to establish an isolation enclosure that atmospherically isolates a volume 171 containing the electrical contacts. The gap 170 can be formed prior to electrical communication (e.g., contact or engagement) of the electrical contacts, as well as prior to engagement of the interlock mechanism 160. For example, the connector bodies 101, 102 and the electrical contacts can be configured to provide adequate distances 127*a-c* (FIG. 3B) between corresponding electrical contacts when the gap 170 is initially formed to ensure that the volume 171 and the electrical contacts are isolated from the surrounding environment well before connection of the electrical contacts (e.g., by physical contact or arcing). Thus, any spark or flame path is cut-off before the electrical contacts get near one another, thereby preventing an explosion of combustible gases that may surround the connector 100 due to arcing between the electrical contacts. In some embodiments, the gap 170 can be dictated by an acceptable safety standard. For example, the gap 170 can have a dimension 172 that is less than or equal to 0.004 inches to ensure that no spark or flame path exists. As a practical matter, the dimension 172 of the gap 170 can also be greater than 0.001 inches to ensure that the connector bodies 101, 102 can be manually coupled and uncoupled. Smaller gap dimensions may be achieved through polishing of surfaces, surface treatment, choice of materials and the like.

Figure 3C:
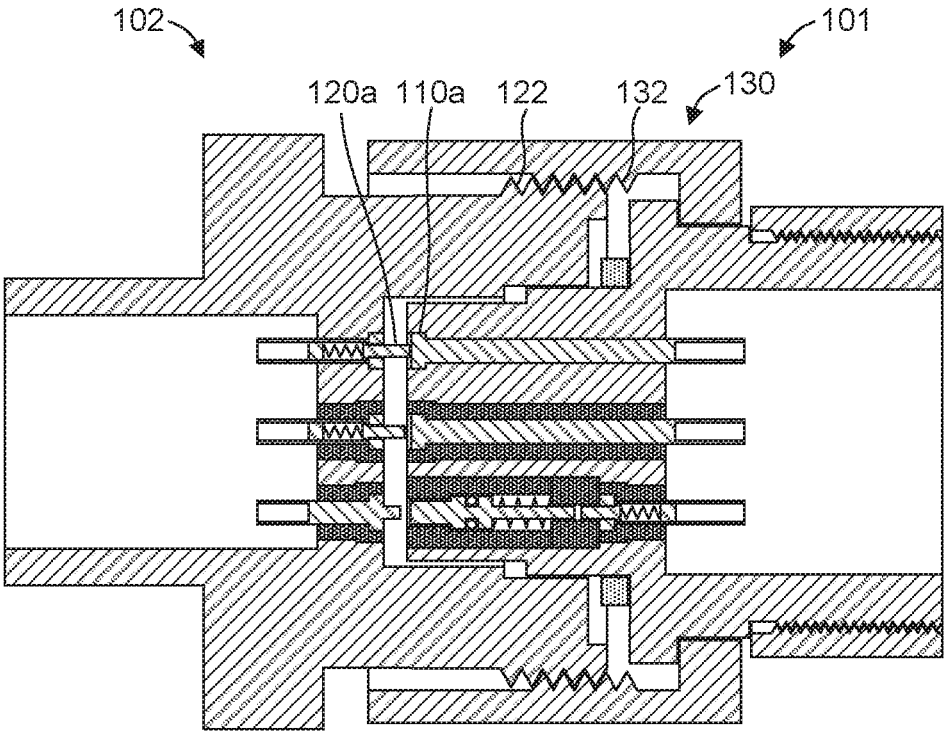
Figure 3D:
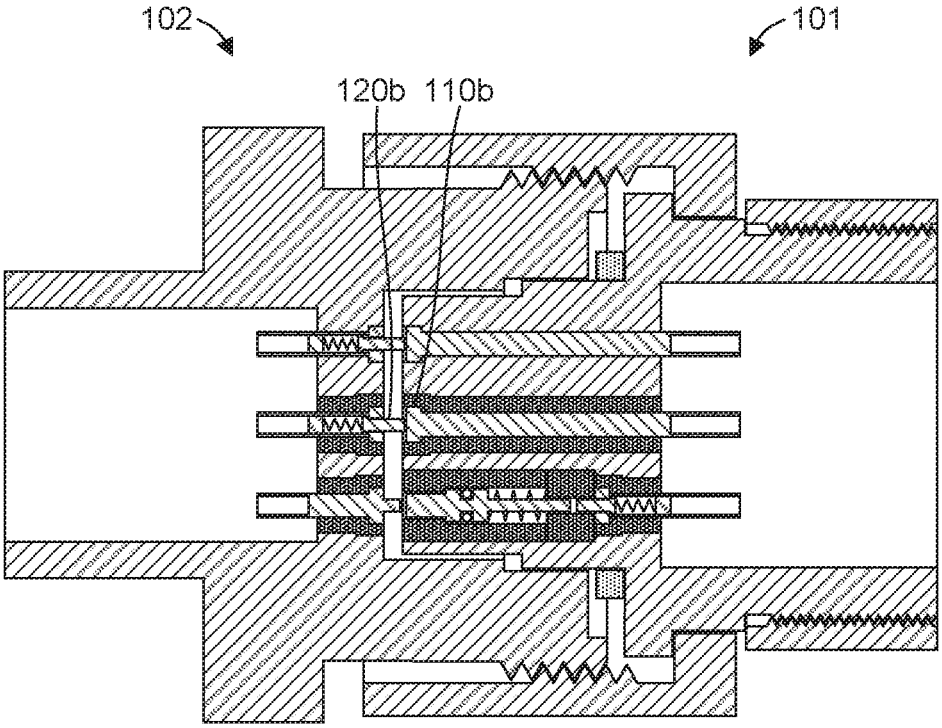

With the outer and inner surfaces 111, 121 engaged and isolating the electrical contacts, the connector bodies 101, 102 can safely be moved further toward one another. This movement can be caused by the threaded engagement of the threaded surface 132 of the securing member 130 and the threaded surface 122 of the connector body 102. As shown in FIG. 3C, ground contacts 110*a*, 120*a* can contact one another prior to contact of the other corresponding electrical contacts. In addition to configuring appropriate protrusion lengths 125*a-c* (FIG. 1), the tight fit between the outer and inner surfaces 111, 121 can maintain a proper orientation of the connector bodies 101, 102 to one another (i.e., tilting relative to the axis 104) that ensures a consistent preferential order of engagement/disengagement of the corresponding electrical contacts. Following contact of the ground contacts 110*a*, 120*a*, one or more supply, common, and/or neutral corresponding contacts can contact one another. For example, as shown in FIG. 3D, the corresponding electrical contacts 110*b*, 120*b* can contact one another. Any number of any type of corresponding electrical contacts can be configured to contact one another in any order following the contact of the ground contacts 110*a*, 120*a*. However, some orders of contact can be more desirable than others depending on specific applications.

The order of pin contact might be needed to ensure a specific order of operations in equipment energization. For example, multiple systems powered off a single multiconductor coupling can require that a first system A is energized immediately prior to System B, immediately prior to System C, etc. In another example, the order of operations is triggering a sequence of illumination or an alarm sequence, etc. By changing the coupling system, the time interval between pin contacts can be varied, as well. In the illustrated example, a threaded collar controls a separate time interval for contacts to connect. More threads per inch increases this time interval. Multiple collar engagements can further change the coupling time interval based on specific applications.

Figure 3E:
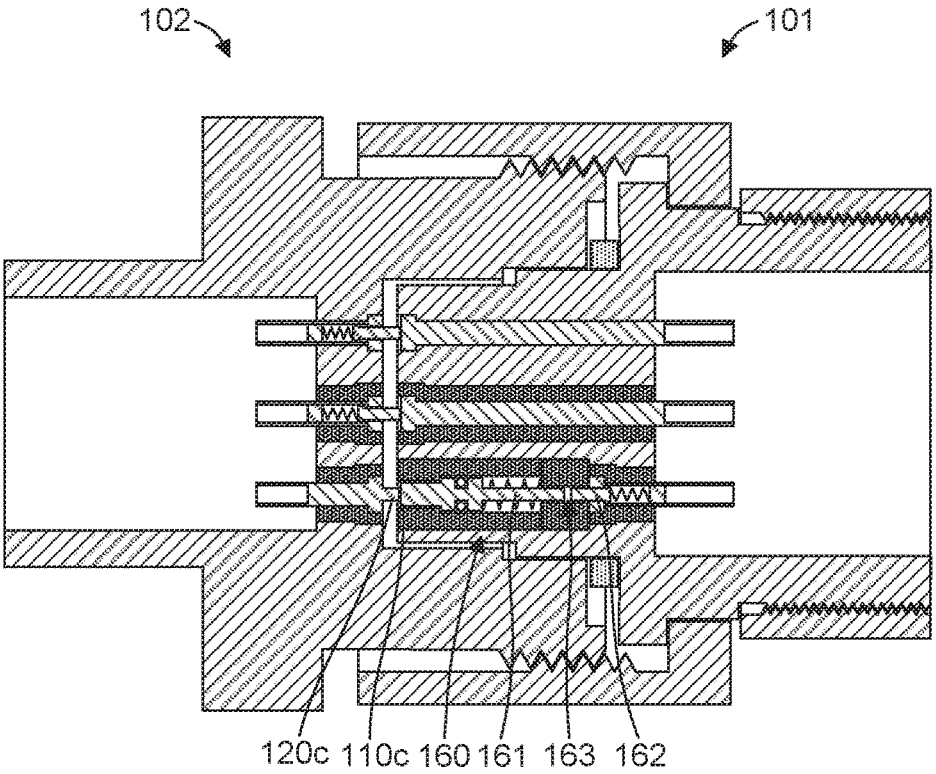
Figure 3F:
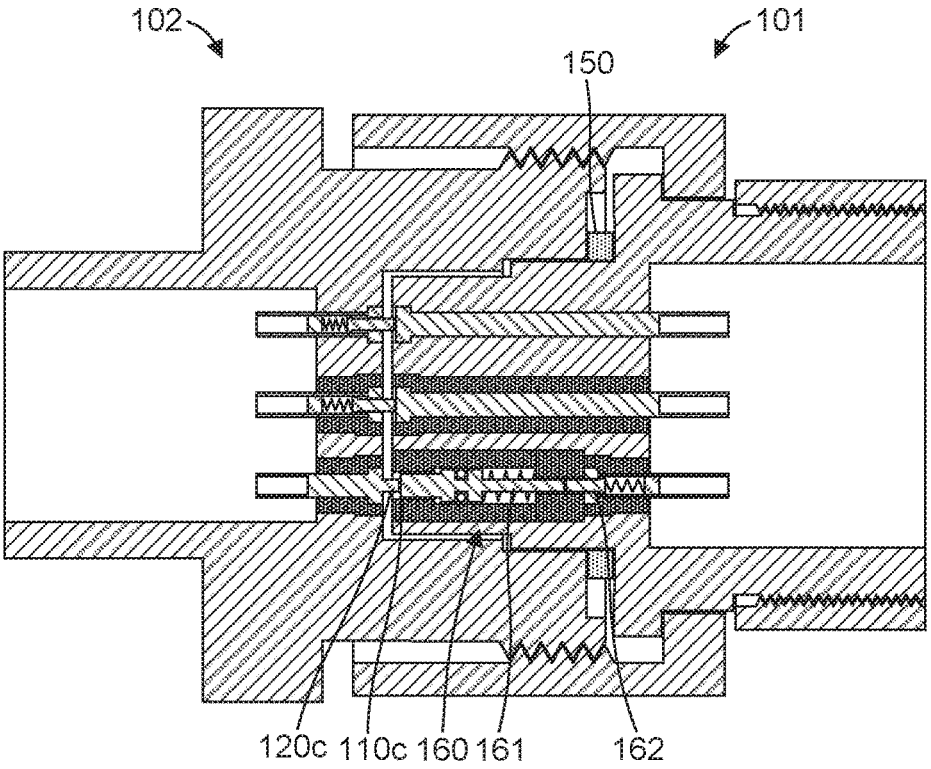

In some embodiments, the corresponding electrical contacts 110*c*, 120*c* can be configured to contact one another last after contact of all other electrical contacts when coupling the connector bodies 101, 102, as shown in FIG. 3E. In such cases, the electrical contact 110*c* may be a supply, common, neutral or sensor line contact and may be associated with or configured as an interlock mechanism 160. At the point of contact between the corresponding electrical contacts 110*c*, 120*c*, as shown in FIG. 3E, there is no electrical continuity through the interlock mechanism 160 due to the separation of the interlock contacts 161, 162 via gap 163. By moving the connector bodies 101, 102 further toward one another, as shown in FIG. 3F, the interlock contacts 161, 162 can contact one another and provide electrical continuity through the interlock mechanism 160, thereby energizing the connection between the electrical contacts 110*c*, 120*c*. In one embodiment, both connector bodies 101, 102 may be in contact with the seal 150 at about the point where the corresponding electrical contacts are in contact with one another.

Figure 3G:
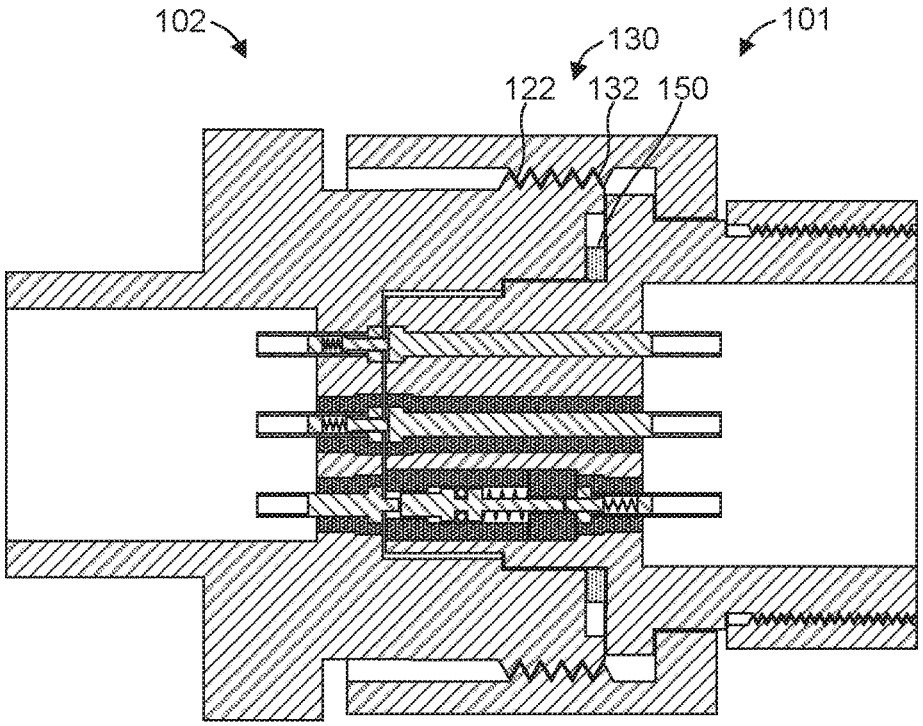

The connector bodies 101, 102 can be further moved toward one another to compress the seal 150 between the connector bodies 101, 102, as shown in FIG. 3G. The threaded engagement of the threaded surface 132 of the securing member 130 and the threaded surface 122 of the connector body 102 can cause this compression of the seal 150 and secure the connector bodies 101, 102 to one another. At this point the connector bodies 101, 102 are fully engaged and all the pogo pin contacts are compressed and in contact with corresponding contacts. In one embodiment, five thread turns of the securing member 130 can fully engage the connector bodies 101, 102.

The above-described process for connecting the connector bodies 101, 102 is generally reversed when disconnecting the connector bodies, which disconnects the various electrical connections formed during connection of the connector bodies. Thus, as the connector bodies 101, 102 begin to separate from one another, the interlock contacts 161, 162 of the interlock mechanism 160 can also separate from one another creating an electrical discontinuity in an energized line and thereby prevent sparks from occurring regardless of any space between contacts. In addition, all electrical contacts are separated from one another while the inner and outer surfaces 111, 121 are still engaged with one another, with ground contacts being the final contacts to separate to avoid sparks or arcing. The electrical contacts are therefore isolated from the exterior environment of the connector 100 until well after the corresponding contacts have separated from one another with no flame or spark path existing to the exterior of the connector that could potentially ignite flammable material (e.g., gases). These features allow the connector bodies to be safely separated from one another in a hazardous area (e.g., an industrial environment) without the need for a user to actively switch off power to the connector 100. In addition, because the interlock mechanism 160 mechanically severs power in the connector body 101 that supplies power to the connector body 102, the connector bodies are both safe after they have been separated from one another.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

What is claimed is:

1. A safety electrical power connector, comprising:

a first connector body having a first electrical contact and an outer surface; and a second connector body that engages the first connector body in an axial direction, the second connector body having a second electrical contact and an inner surface configured to slide relative to the outer surface of the first connector body in the axial direction during engagement of the first and second connector bodies, wherein the outer surface and the inner surface define a gap therebetween sufficient to establish an isolation enclosure that isolates a volume containing the first and second electrical contacts therein, the gap being formed prior to electrical communication of the first and second electrical contacts thereby preventing an explosion due to arcing between the first and second electrical contacts, and wherein the first and second electrical contacts comprise corresponding first and second supply contacts and corresponding first and second ground contacts, the first and second ground contacts being operable to contact one another prior to the first and second supply contacts contacting one another as the first connector body is engaged with the second connector body.

2. The safety electrical power connector of claim 1, wherein the outer and inner surfaces are cylindrical.

3. The safety electrical power connector of claim 1, wherein the gap is less than or equal to 0.004 inches.

4. The safety electrical power connector of claim 1, wherein the first and second electrical contacts comprise a plurality of corresponding first and second supply contacts.

5. The safety electrical power connector of claim 1, wherein the first and second ground contacts are operable to disconnect from one another after the first and second supply contacts disconnect from one another as the first connector body is disengaged from the second connector body to prevent sparking.

6. The safety electrical power connector of claim 1, wherein the first ground contact comprises a pogo pin or a fixed pin, and the second ground contact comprises the other of the pogo pin or the fixed pin.

7. The safety electrical power connector of claim 1, wherein the first supply contact comprises a pogo pin or a fixed pin, and the second supply contact comprises the other of the pogo pin or the fixed pin.

8. The safety electrical power connector of claim 1, wherein the first and second electrical contacts further comprise corresponding first and second neutral contacts.

9. The safety electrical power connector of claim 1, wherein the first and second electrical contacts each comprise a pin, a pogo pin, a receptacle, a landing, a pad, or a combination thereof.

10. The safety electrical power connector of claim 1, wherein the first connector body is configured as a plug and the second connector body is configured as a socket that receives the plug.

11. The safety electrical power connector of claim 1, wherein the first connector body comprises a first alignment surface, and the second connector body comprises a second alignment surface that engages and mates with the first alignment surface to facilitate alignment of the first and second electrical contacts.

12. The safety electrical power connector of claim 11, wherein the first and second alignment surfaces engage prior to the outer and inner surfaces during engagement of the first and second connector bodies.

13. The safety electrical power connector of claim 1, further comprising an interlock mechanism associated with the first electrical contact or the second electrical contact that provides electrical continuity when the first and second connector bodies are fully engaged and severs electrical continuity when the first and second connector bodies become disengaged.

14. The safety electrical power connector of claim 13, wherein the interlock mechanism comprises a first interlock contact and a second interlock contact that contact one another when the first and second connector bodies are fully engaged, and separate from one another to sever electrical continuity when the first and second connector bodies become disengaged.

15. The safety electrical power connector of claim 14, wherein the first interlock contact is spring-loaded and biased away from the second interlock contact.

16. The safety electrical power connector of claim 15, wherein the second interlock contact is spring-loaded and biased toward the first interlock contact.

17. The safety electrical power connector of claim 1, further comprising a securing member associated with the first connector body or the second connector body to secure the first and second connector bodies to one another.

18. The safety electrical power connector of claim 17, wherein the securing member comprises a threaded sleeve configured to threadingly engage a threaded surface of the other of the first connector body or the second connector body.

19. The safety electrical power connector of claim 17, wherein the securing member is constructed of a metal material.

20. The safety electrical power connector of claim 1, further comprising a seal configured to interface with the first and second connector bodies to form a seal between the first and second connector bodies.

21. The safety electrical power connector of claim 20, wherein the seal is disposed about the first connector body proximate the outer surface.

22. The safety electrical power connector of claim 20, wherein the seal is constructed of a polymeric material.

23. The safety electrical power connector of claim 1, wherein at least one of the first connector body and the second connector body is constructed of a metal material.

24. The safety electrical power connector of claim 23, wherein the first and second electrical contacts are separated from the metal material by electrically insulative liners.

* * * * *